US006685533B1

(12) United States Patent
Lee

(10) Patent No.: US 6,685,533 B1
(45) Date of Patent: Feb. 3, 2004

(54) REPRODUCIBLE DOLL

(76) Inventor: In Bong Lee, 105-1406 Hyunju Apartment, Dankudong, Wonjushi, Kangwondo (KR)

( * ) Notice: Subject to any disclaimer, the term of this patent is extended or adjusted under 35 U.S.C. 154(b) by 0 days.

(21) Appl. No.: 10/201,139

(22) Filed: Jul. 24, 2002

(51) Int. Cl.[7] ..... A63H 3/36

(52) U.S. Cl. ..... 446/373; 446/100; 446/101; 434/274

(58) Field of Search ..... 446/373, 100, 446/101, 268, 321, 369–375, 378, 379, 382, 376, 384; 223/120, 66, 68; 434/267, 274, 275

(56) References Cited

U.S. PATENT DOCUMENTS 1,347,993 A * 7/1920 Dawley ..... 434/296
2,285,472 A * 6/1942 Tenenbaum ..... 446/375
3,357,610 A * 12/1967 Quinby, Jr. ..... 223/68
5,752,869 A * 5/1998 Huff ..... 446/104
6,074,270 A * 6/2000 Wilcox et al. ..... 446/370

* cited by examiner

*Primary Examiner*—Derris H. Banks
*Assistant Examiner*—Bena B. Miller
(74) *Attorney, Agent, or Firm*—Dickinson Wright PLLC

(57) ABSTRACT

Disclosed is a reproducible doll which a user can assemble to simulate a desired type of person or animal by himself or herself. According to the present invention, a desired type of doll is made in such a manner that the head, hands, feet, etc. shaped like corresponding portions of a real person or animal are connected by means of a plurality of connecting bars that form artificial bone sections. Joints are formed on the connecting bars to detachably and bendably connect the connecting bars, and artificial muscle sections and artificial skin sections made of elastic materials having elasticity are sequentially fitted with the outsides of the artificial bone sections.

7 Claims, 10 Drawing Sheets

REPRODUCIBLE DOLL

BACKGROUND OF THE INVENTION

1. Field of the Invention

The present invention relates to a reproducible doll, and more particularly, to a reproducible doll which enables a variety of elements, such as eyebrows, eyes, nose, mouth, and ears to be attached to or detached from corresponding recesses of a head of the doll. The attachment and detachment are made according to diverse shapes of the head to make a user feel aesthetic pleasure, and enables hair, e.g., dyed hair, or short cut hair to be worn on the head of the doll to enable the user to groom the hair of the doll to conform to his/her favorite style.

2. Background of the Related Art

In general, there are many types of dolls with which children can play. Such dolls are largely divided into two types, i.e., finished dolls which are completely assembled in manufacturing factories and then distributed, and prefabricated dolls which are designed to allow users to assemble them by themselves.

The former is manufactured to simulate some specific characters or take particular shapes from the beginning, such that disadvantageously they cannot satisfy the diverse tastes and preferences of all children. Finally, the child loses interest in the dolls in a short time and as a result, parents cannot help buy new dolls for them, thereby causing an economic burden.

The latter attracts more attention from children than the former by permitting the child to assemble the dolls by themselves. The latter, however, have the disadvantage of failing to make a favorable impression on the children or excite a great interest for them since it is utilized in such a manner that some specific prefabricated parts, e.g., the head, torso, arms, and legs, are fitted into corresponding places and desired clothing is worn on the parts.

SUMMARY OF THE INVENTION

Accordingly, the present invention is directed to a reproducible doll that substantially obviates one or more problems due to limitations and disadvantages of the related art.

An object of the present invention is to provide a reproducible doll, in which a user can assemble a doll having the likeness of a human being or an animal to satisfy his or her taste by using prepared bone sections, artificial skin sections and artificial muscle sections, and varying the shapes of the head, hands and feet.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as in the appended drawings.

To achieve these objects and other advantages and in accordance with the purpose of the invention, as embodied and broadly described herein, there is provided a reproducible doll including a head, hands, and feet, the doll comprising: a plurality of connecting bars integrally connected with the head, hands and feet to form bone sections; a plurality of bending sections adapted to detachably connect the plurality of connecting bars with each other and each of the head, hands and feet with a corresponding one of the connecting bars to form joints of the bone sections; and a plurality of artificial skin sections separately worn on the outsides of the plurality of connecting bars connected with each other through the plurality of bending sections to form arm, leg and torso portions of the doll.

It is preferable that artificial muscle sections for adjustment of a body type are detachably overlain on limb portions of the connecting bars. The doll is dividable into a muscular type, a fat type and a thin type according to whether the artificial muscle sections are made. The artificial skin sections are worn on the artificial muscle sections.

Further, the artificial muscle sections for adjustment of a body type are made of materials having elasticity, and formed of a hollow body having openings formed at both ends thereof and a cut portion formed thereon along a longitudinal direction thereof to correspond to the shapes of the arm and leg portions of the doll to be easily inserted into the limb portions.

It is preferable that insertion holes for attaching or detaching hair, nose, eyes, and mouth to or from the head are further formed on the head.

Each of the bending sections includes globular portions respectively formed on ends of the head, hands and feet and on both ends of the connecting bars, and a connecting mechanism having recesses on both ends thereof to detachably and movably receive the globular portions.

The artificial skin sections are made of flexible materials having elasticity, such as silicon.

Further, the artificial skin sections are preferably formed in such color as white, yellow and black.

Each of the hands includes fingers having connecting bars and bending sections for detachably interconnecting the connecting bars, and a palm portion connected to the fingers, wherein the artificial skin sections are worn on the fingers and the palm portion.

Each of the feet includes toes having connecting bars and bending sections for detachably interconnecting the connecting bars, and a sole portion connected to the toes, wherein the artificial skin sections are worn on the toes and the sole portion.

The present invention constructed as above enables a user to make a doll represent a celebrity, a popular character, or his/her own self. Furthermore, the artificial skin sections donned over the bone sections look realistic. The doll can be easily assembled into a toy having the likeness of an adult or a child by adjusting the length of the joints of the bone sections.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
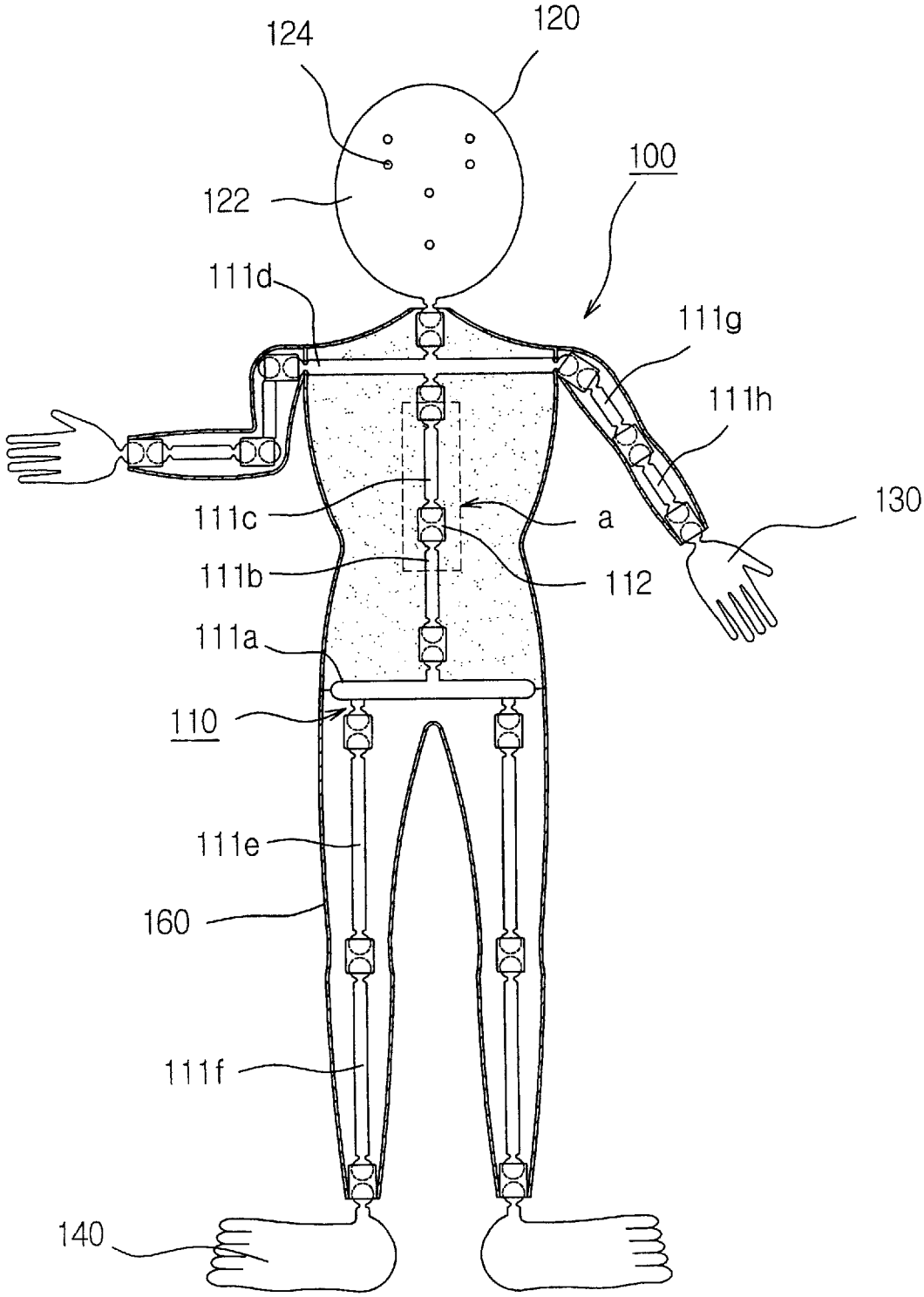
FIG. 1 is a front view of a reproducible doll according to the present invention.
Figure 2:
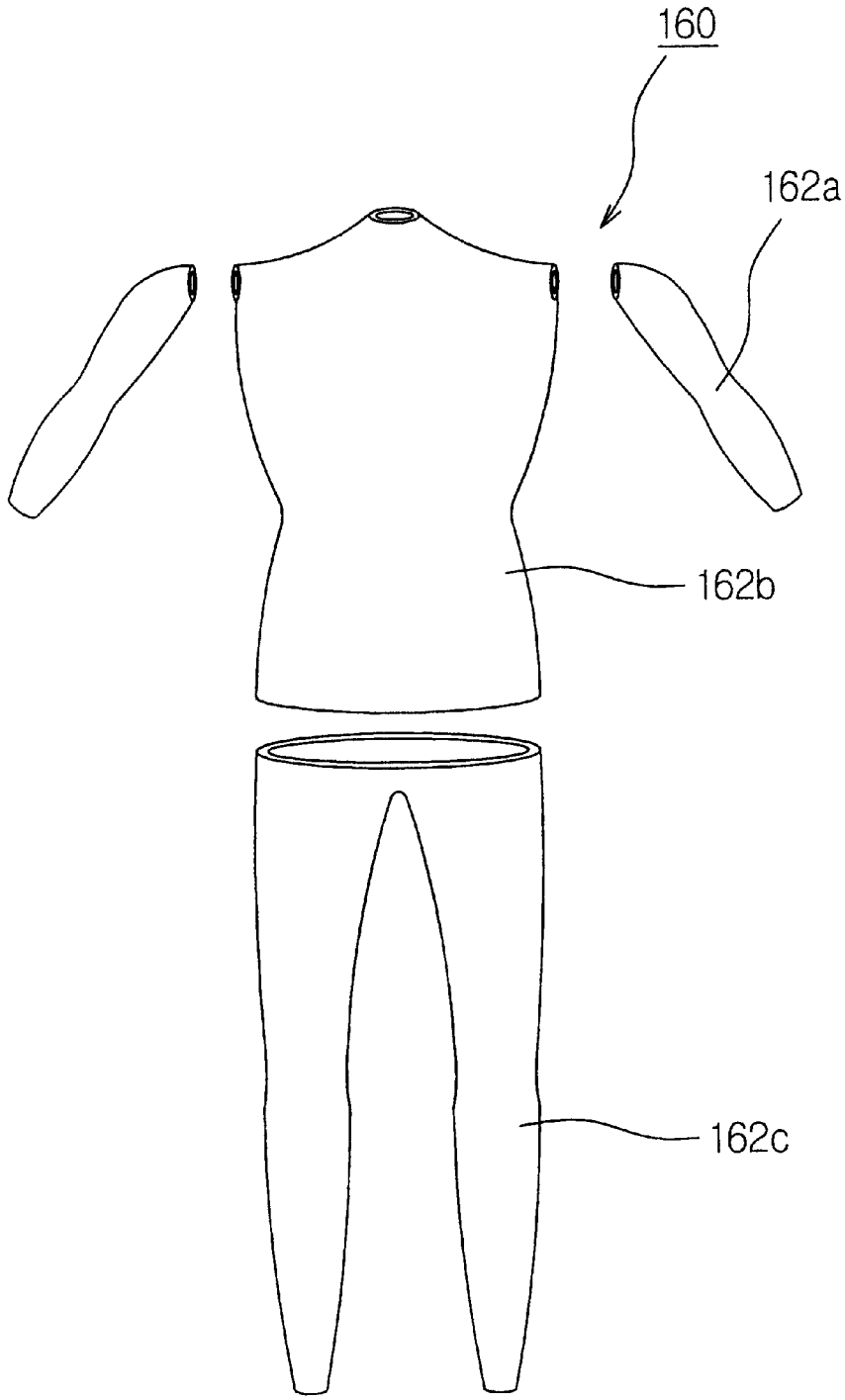
FIG. 2 is a perspective view illustrating artificial skin sections used in the reproducible doll according to the present invention.
Figure 3A:
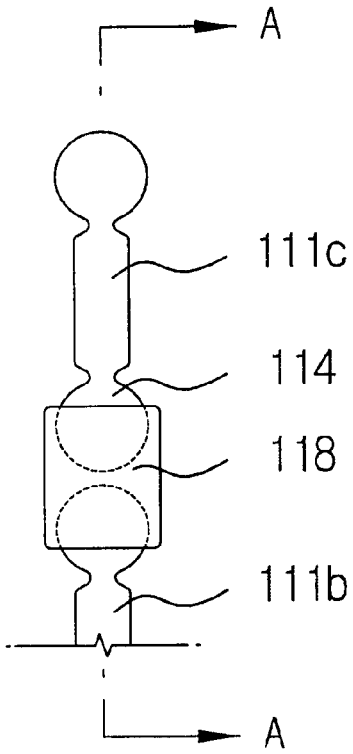
FIG. 3A is an enlarged view of the portion a of FIG. 1.
Figure 3B:
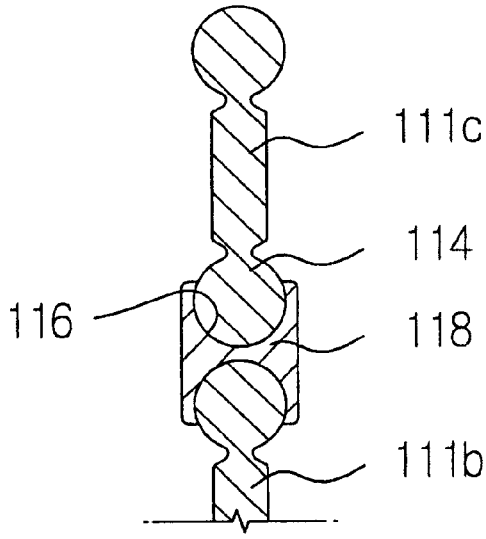
FIG. 3B is a cross-sectional view taken along the line of A—A of FIG. 3A.

FIG. 1 is a front view of a reproducible doll according to the present invention. FIG. 2 is a view illustrating artificial skin sections used in the reproducible doll according to the present invention. FIG. 3A is an enlarged view illustrating the portion a of FIG. 1, and FIG. 3B is a cross-sectional view taken along the line A—A of FIG. 3A.

Referring to the drawings, a reproducible doll 100 according to the present invention includes artificial bone sections 110 which can be assembled and disassembled, a head 120, hands 130 and feet 140 which can be assembled and disassembled in the artificial bone sections 110, and artificial skin sections 160 which can be freely worn on the artificial bone sections 110 to adjust thickness and color of the skin.

The artificial bone sections 110 are made of such materials as plastic for the purpose of achieving the same strength as real bones while being of a lighter weight than the real bones. The artificial bone sections 110 are formed by assembling a plurality of connecting bars 111*a* through 111*h*. A wanted frame of doll 100 is obtained in such a manner that the prepared head 120, hands 130 and feet 140 are connected to ends of the connecting bars 111*a* through 111*h* which form the artificial bone sections 110. The size of the artificial bone sections 110 can be adjusted in accordance with the number or length of the assembled connecting bars 111*a* through 111*h*. In consequence, a user can choose a doll sized to his or her taste, in other words, select either between a child-looking doll or an adult-looking doll and assemble the chosen doll. The number of connecting bars 111*a* through 111*h* is variable according to the size of the doll. Further, the length or width of the connecting bars 111*a* through 111*h* which form the artificial bone sections 110 is also variable according to the size or kind of the doll.

Bending sections 112 are provided on the plurality of connecting bars 111*a* through 111*h* which form the artificial bone sections 110 to bend 90 degrees in an arbitrary direction, or to pivotally rotate. The plurality of bending sections 112 form joints of the artificial bone sections 110. Since the bending sections are of the same construction, only sections denoted by reference numeral 112 will be explained with reference to FIGS. 3A and 3B as follows.

The bending sections 112 detachably connect the connecting bars 111*a* through 111*h* with each other and each of the head 120, hands 130 and feet with a corresponding one of the connecting bars 111*a* through 111*h* so that the connecting bars, and the head, hands and feet can bend. Each of the bending sections 112 includes globular portions 114 respectively formed on ends of the head 120, hands 130 and feet 140 (see FIGS. 5D and 5E) and on both ends of the connecting bars 111*a* through 111*h*, and a substantially cylindrical connecting mechanism 118 having recesses 116 formed on both ends thereof for movably receiving the globular portions 114. Since the connecting mechanism 118 is made of plastic materials having elasticity, it elastically supports the globular portions 114 so that the globular portions 114 received into the recesses 116 of the connecting mechanism 116 would not be separated without an external force. Open portions of the recesses 116 are slightly smaller than the outside diameter of the globular portions 114. However, the recesses 116 are made of materials having elasticity, whereby insertion or separation of the globular portions 114 into or from the recesses 116 does not cause much harmful effect by virtue of the elasticity. The length or width of the connecting bars 111*a* through 111*h* which form the artificial bone sections 110 is also variable according to the type of doll. By way of example, there can be manufactured a doll which is selected from a smaller doll and a taller doll by adjusting the length of the connecting bars 111*a* through 111*h*.

The wanted figure can be accomplished in such a manner that the artificial skin sections 160 made of flexible silicon materials are donned over the artificial bone sections 110 which form the body frame while being assembled through the bending sections 112 of the connecting bars 111*a* through 111*h*. That is to say, the artificial skin sections 160 are separately formed on the respective portions of arms 162*a*, torso 162*b* and legs 162*c*, whereby they are structured to be easily worn on the artificial bone sections 110. The outward appearance of the artificial skin sections 160 looks like corresponding portions of a real person. In structure, the artificial skin sections 160 are open at both ends thereof and hollow inside thereof so as to be easily donned on the artificial bone sections 110. That is, the arm and leg portions 162*a* and 162*c* of the artificial skin sections 160 are formed of a hollow body having openings at only both ends thereof, whereby they can be easily donned on the limb portions of the artificial bone sections as if clothing is donned over the limb portions. In the meanwhile, the torso portion 162*b* of the artificial skin sections 160 is open on upper and lower portions thereof and on portions connected to both arms so that it can be easily worn on the torso portion of the artificial bone sections 110.

Upon wearing the artificial skin sections 160 of the torso portion 162*b* on the artificial bone sections 110, it is desirable that they have to be worn before the head 120, hands 130 and feet 140 as well as the artificial bone sections of the arms and legs are assembled. The artificial skin sections 160 are preferably made of such material as silicon, which is not harmful to human beings, and is elastic, soft and flexible. The artificial skin sections 160 made of the materials like silicon has elasticity in material characteristics. Therefore, the artificial skin sections 160 are closely contacted with the artificial bone sections 110 after being worn on the artificial bone sections 110, whereby they would not be removed without intention. Furthermore, upon manufacturing the artificial skin sections 160, the artificial skin sections 160 can be manufactured in white, yellow, or black for different races by applying colors thereto. As a result, the artificial skin sections 160 can be manufactured to optionally represent one out of the white, yellow and black races according to the color thereof. It should be appreciated that such constructions can be sufficiently executed within the scope of the present invention even though they are not illustrated in figures.

Figure 4A:
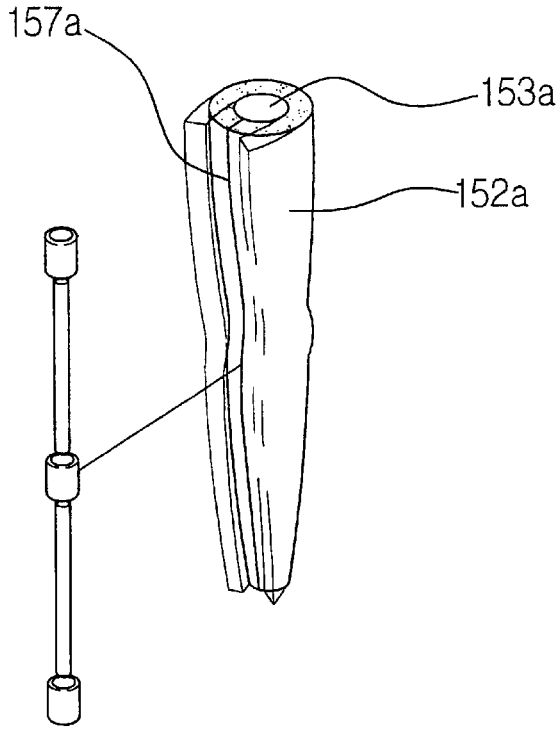
FIG. 4A is a perspective view illustrating a leg artificial muscle fitted with a leg bone portion of the reproducible doll according to the present invention.
Figure 4B:
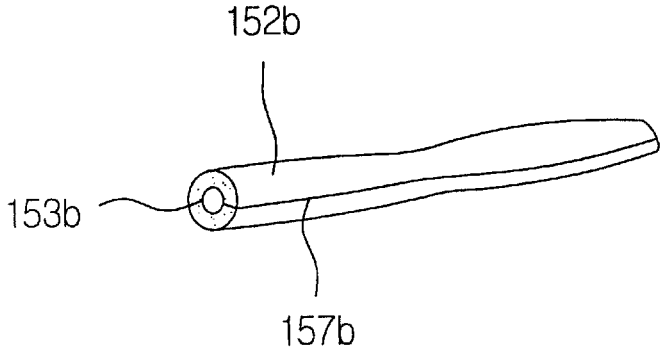
FIG. 4B is a perspective view illustrating an arm artificial muscle fitted with an arm bone portion of the reproducible doll according to the present invention.

FIG. 4A is a perspective view illustrating a leg artificial muscle fitted with a leg bone portion of the reproducible doll according to the present invention. FIG. 4B is a perspective view illustrating an arm artificial muscle fitted with an arm bone portion of the reproducible doll according to the present invention.

Artificial muscle sections 152*a* and 152*b* can be fitted with the artificial bone sections 110 (see FIG. 1) of the arm and leg portions while completely surrounding the artificial bone sections 110. With the aid of the artificial muscle sections 152*a* and 152*b*, the doll can be manufactured into any one among a muscular type, a fat type and a thin type, and also the joints of the connecting bars 111*a* through 111*h*, that is, the bending sections 112 can bend more freely. Adjustment of a body type by the artificial muscle sections 152*a* and 152*b* can be achieved as the width of the artificial muscle sections 152*a* and 152*b* is adjusted. The artificial muscle sections 152*a* and 152*b* for adjustment of a body type are made of flexible materials having elasticity, such as sponge, whereby they can be easily manufactured into ones having width suitable for respective figures. The artificial muscle sections 152*a* and 152*b* are shaped like the arm or leg portions of a real human body. The artificial muscle sections 152*a* and 152*b* are of a hollow cylindrical shape, such that both ends 153*a* and 153*b* thereof are open and cut portions 157*a* and 157*b* are formed along the whole longitudinal direction at one side thereof. The cut portions 157*a* and 157*b* serve to easily fit or separate the artificial muscle sections 152*a* and 152*b* with or from the artificial bone sections 110 of the arm or leg portions. The artificial muscle sections 152*a* and 152*b* are made of such materials as sponge, whereby the cut portions 157*a* and 157*b* formed at one side thereof can be open to the position of an imaginary line of FIG. 4A without great effort and the artificial muscle sections 152*a* and 152*b* can be easily fitted with the artificial bone sections 110 of the arm or leg portions through the spaces formed by the open cut portions 157*a* and 157*b* of the artificial muscle sections 152*a* and 152*b*.

Once the force that is applied to open the cut portions 157*a* and 157*b* is removed from the cut portions 157*a* and 157*b* of the artificial muscle sections 152*a* and 152*b* after the artificial muscle sections 152*a* and 152*b* are fitted with the artificial bone sections 110, the artificial muscle sections 152*a* and 152*b* readily return to their original positions due to the elasticity thereof while surrounding the artificial bone sections 110. The artificial skin sections 160 illustrated in FIG. 2 are finally worn on the artificial muscle sections 152*a* and 152*b* that are positioned on the artificial bone sections 110, thereby forming a smooth skin. Moreover, while the artificial muscle sections 152*a* and 152*b* are particularly described to be positioned on only the arms or legs, the invention is not limited thereto. Corresponding artificial muscle sections 152*a* and 152*b* can be disposed inside the artificial skin sections 162*b* (see FIG. 2) positioned on the bone 110 of the torso portion. For example, artificial muscle sections which are previously shaped like the artificial skin sections 162*b* may be inserted into the inside of the artificial skin sections 162*b* overlain on the bone sections 110 of the torso portion so as to change the figure of the torso portion, or as shown by dots in FIG. 1, fillers, such as sponge, cotton, or the like, may be filled thereinto so that the torso portion as well as the arm and leg portions can be changed in the figure thereof.

Figure 5A:
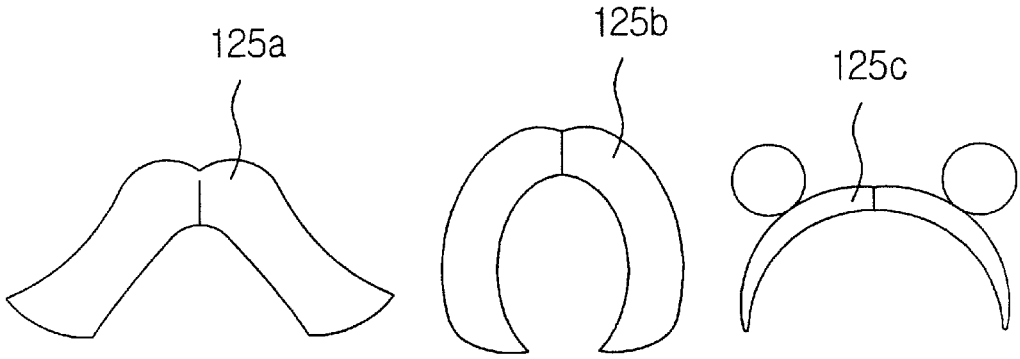
FIG. 5A is a view illustrating styles of hair used in the reproducible doll according to the present invention.
Figure 5B:
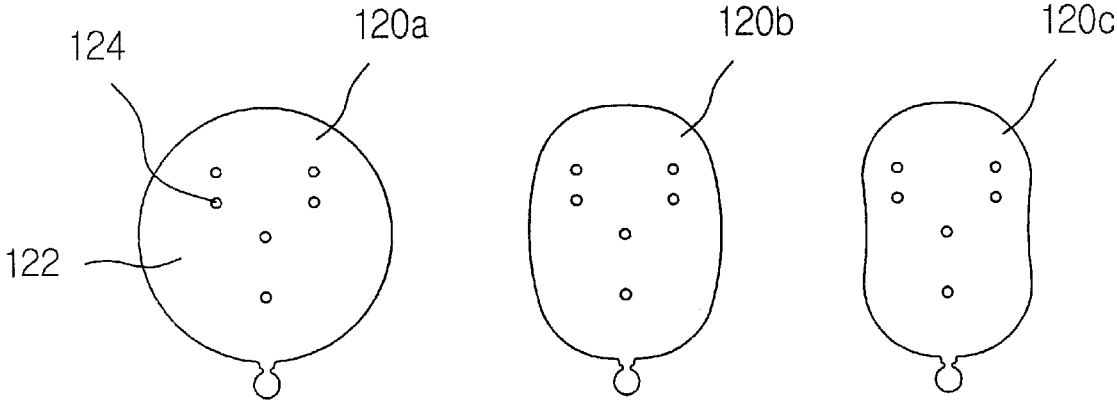
FIG. 5B is a view illustrating shapes of a head used in the reproducible doll according to the present invention.
Figure 5C:
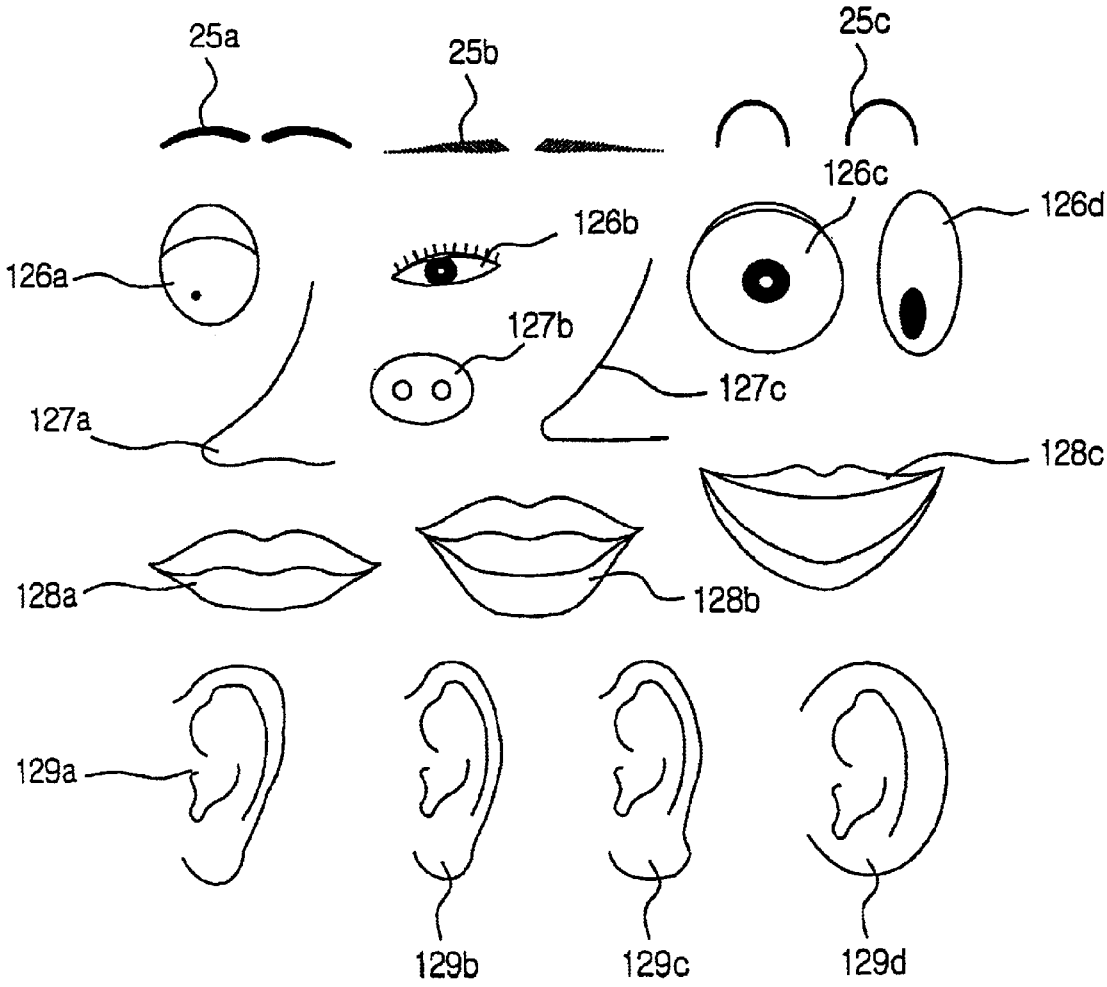
FIG. 5C is a view illustrating shapes of the eyebrows, eyes noses, mouths and ears used in the reproducible doll according to the present invention.
Figure 5D:
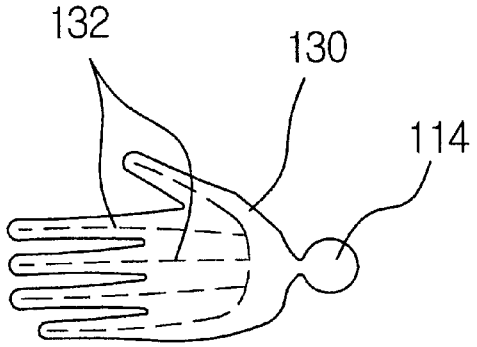
FIGS. 5D and 5E are views illustrating shapes of a hand and a foot used in the reproducible doll according to the present invention.
Figure 5E:
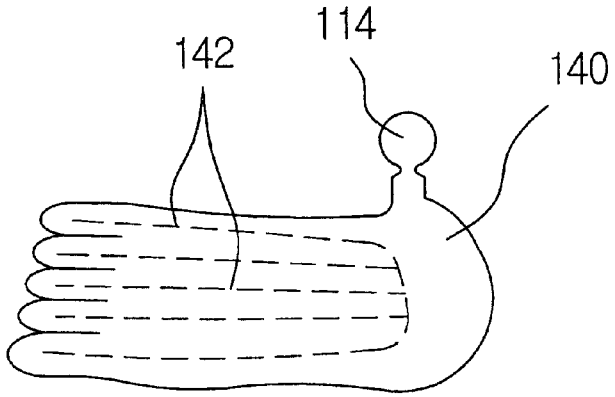

FIG. 5A is a view illustrating styles of hair used in the reproducible doll according to the present invention. FIG. 5B is a view illustrating shapes of a head used in the reproducible doll according to the present invention. FIG. 5C is a view illustrating shapes of eyebrows, eyes, noses, mouths, and ears used in the reproducible doll according to the present invention. FIGS. 5D and 5E are views illustrating shapes of a hand and a foot used in the reproducible doll according to the present invention.

The hair, noses, eyes, eyebrows and mouths are detachably mounted on the head 120 of the doll to form the head.

Initially, FIG. 5A is a view illustrating various shapes of hair 125*a* to 125*c* worn on the head 120 of the reproducible doll 100 according to the present invention. One item selected among the hair 125*a* to 125*c* is worn on the head 120. The hair 125*a* to 125*c* are made of flexible rubber materials, which are not drawn in figures, except hair portions, such that they can be easily worn on the head 120*b* and would not be removed without intention by virtue of the close contact with the head 120. It should be appreciated that the hair style and color of the hairs 125*a* to 125*c* are also variable, which does not depart from the scope of the present invention. For instance, the hair color can be red, blue, or others besides the existing color, gold, silver, and gray, such that a user can choose one among them. The hairstyle is represented to be a wavy cut type, a straight-cut type, or a short cut-type, such that the user can enjoy the wider liberty of choice.

FIG. 5B is a view illustrating shapes of a head used in the reproducible doll.

Referring to FIG. 5B which depicts various shapes of heads 120*a* to 120*c*, the shapes of the heads 120*a* to 120*c* are variable, and the hair 125*a* to 125*c* are shaped depending on the shapes of the heads 120*a* to 120*c*. The heads 120*a* to 120*c* are variable by attaching or detaching the globular portions 114 to or from the recesses 116 of the connecting bars 111*d* which form the bone sections 110. Furthermore, insertion holes 124 are formed on the head 122 of the heads 120*a* to 120*c* to attach or detach the eyes, nose, etc. to or from the head 122. Explanation about the insertion holes 124 will be given with reference to FIG. 5C.

FIG. 5C is a view illustrating shapes of eyes, noses and mouths used in the reproducible doll according to the present invention.

Various shapes of eyebrows 125*a* to 125*c*, eyes 126*a* to 126*d*, noses 127*a* to 127*c*, mouths 128*a* to 128*c* and ears 129*a* to 129*d*, which are made beforehand, are inserted into the insertion holes 124 formed on the head 122 of the heads 120*a* to 120*c*, so as to complete a head. The eyebrows 125*a* to 125*c*, eyes 126*a* to 126*d*, noses 127*a* to 127*c*, mouths 128*a* to 128*c* and ears 129*a* to 129*d* are made of the same materials as the heads 120*a* to 120*c*, such as silicon. Protrusions which are not shown in drawings protrude from the rear sides of them to be inserted into the insertion holes 124.

Otherwise, instead of the protrusions, adhesive surheads may be formed on the rear sides of the eyebrows 125*a* to 125*c*, eyes 126*a* to 126*d*, noses 127*a* to 127*c*, mouths 128*a* to 128*c* and ears 129*a* to 129*d*. The shapes of the eyebrows 125*a* to 125*c*, eyes 126*a* to 126*d*, noses 127*a* to 127*c*, mouths 128*a* to 128*c* and ears 129*a* to 129*d* are not limited to those illustrated in the drawings but other variations may occur.

FIGS. 5D and 5*e* are views illustrating shapes of a hand and a foot used in a reproducible doll according to the present invention.

The hands 130 and feet 140 are made of silicon material, similar to the artificial skin sections 160, and allow wires 132 and 142 to be embedded inside so as to be reinforced. The wires 132 and 142 are integrally embedded upon forming the hands 130 and feet 140, which process is carried out based on a general technology, and thus explanation about the wires 132 and 142 will be omitted.

Figure 6A:
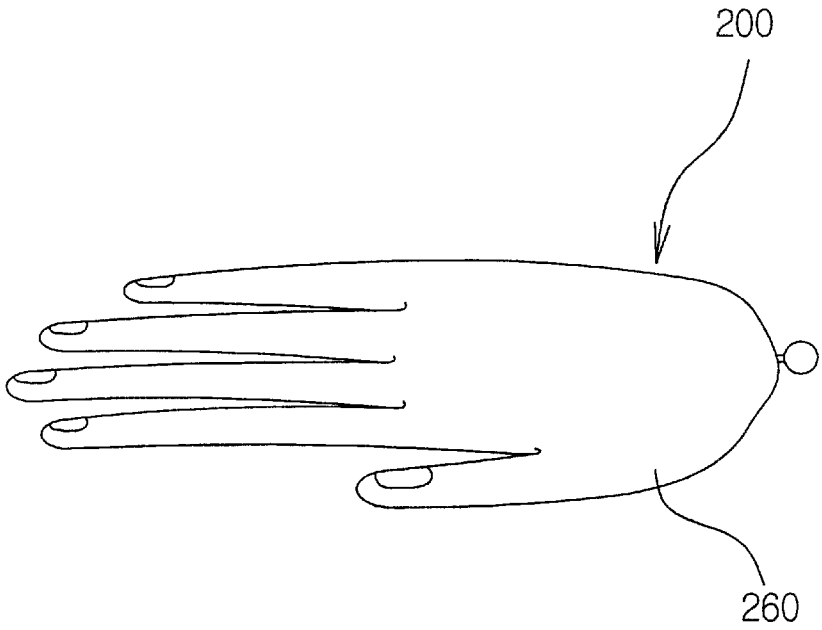
FIGS. 6A and 6B are views illustrating other shapes of the hand used in the reproducible doll according to the present invention.
Figure 6B:
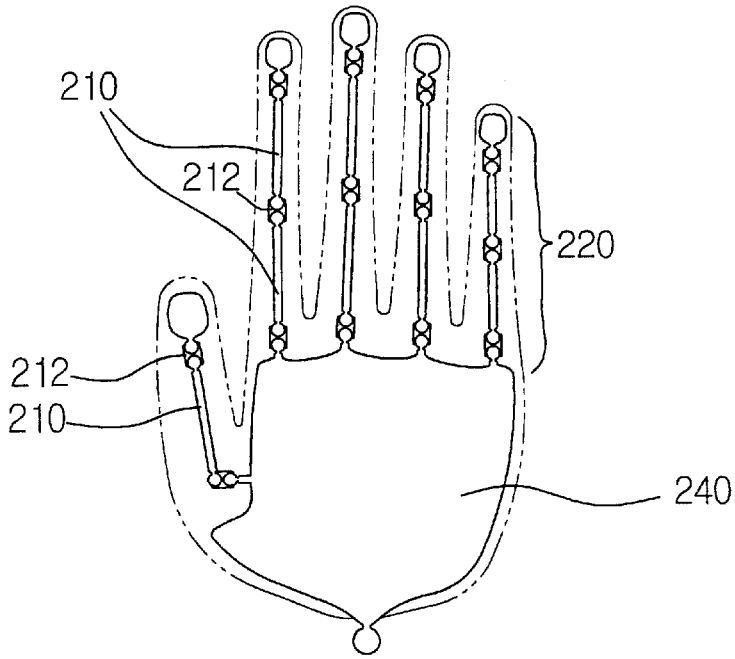

FIGS. 6A and 6B are views illustrating other shapes of the hand used in the reproducible doll according to the present invention.

Each of the hands 200 includes fingers 220 having a plurality of connecting bars 210 and a plurality of bending sections 212 for detachably interconnecting the connecting bars 210, a palm portion 240 connected to the fingers, and an artificial skin 260 worn on the fingers and palm portion. The artificial skin 260 has the same shape as the hand in order to be easily worn on the hand. The artificial skin 260 is especially made of soft silicon material to attain elasticity, so that it can be easily donned over the hand as if gloves are donned over the hands.

The size of the hand 200 is adjustable depending on the size and number of the connecting bars 210 as well. Further, the color of the artificial skin 260, as described in the above embodiments, is variable. Besides, the materials of the connecting bars 210 and palm portion 240, and constructions of the connecting bars 210 and bending sections 212 are the same as those in the above embodiments, and a redundant explanation will be omitted.

Figure 7A:
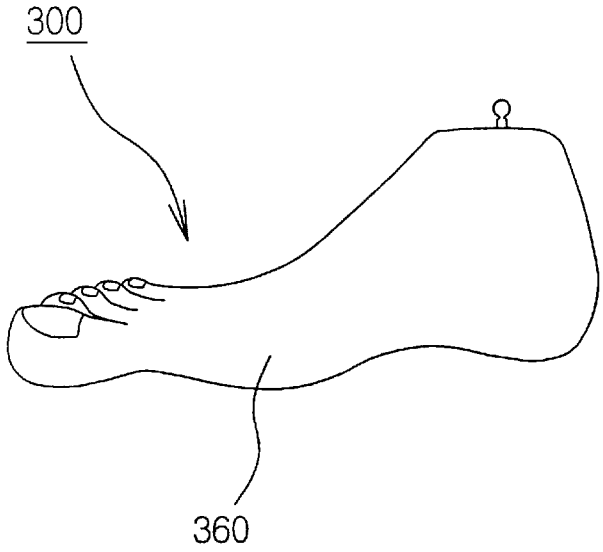
FIGS. 7A and 7B are views illustrating other shapes of the foot used in the reproducible doll according to the present invention.
Figure 7B:
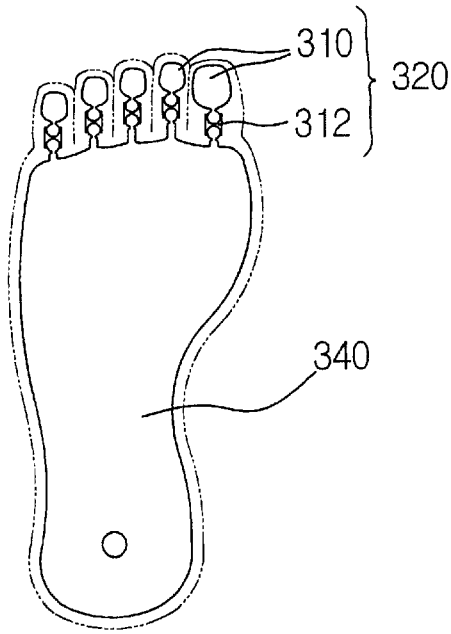

FIGS. 7A and 7B are views illustrating other shapes of the foot used in the reproducible doll according to the present invention.

Each of the feet 300 also includes toes 320 having a plurality of connecting bars 310 and bending sections 312 for detachably connecting the connecting bars 310, and a sole portion 340 connected to the toes 320 and an artificial skin 360 worn on the fingers and sole portion.

The artificial skin 360 is shaped like the foot so as to be easily worn on the foot. The artificial skin 360 is especially made of soft silicon material to attain elasticity, so as to be easily worn in the same way as if socks are worn on the feet.

The size of the feet 300 is also adjustable depending on the size and number of the connecting bars 310. The color of the artificial skin 360 is also variable as described in the above embodiments. In addition, the materials of the connecting bars 310 and the sole and the constructions of the connecting bars and bending sections 312 are the same as those in the previously-described embodiments, and thus a redundant explanation thereof will be omitted.

Figure 8:
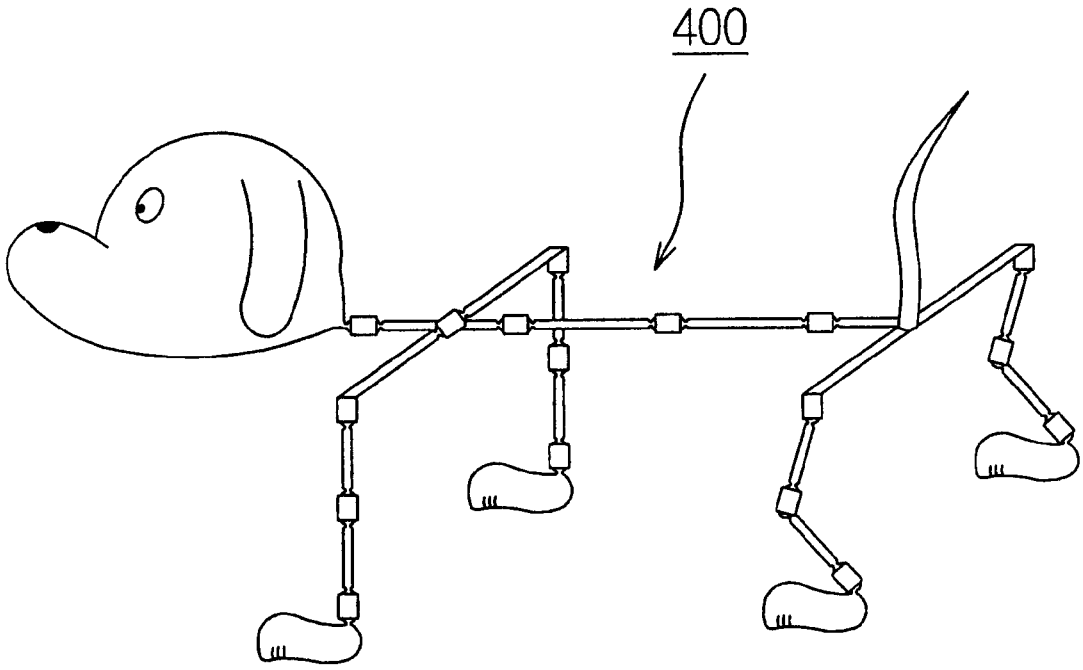
FIG. 8 is a view illustrating the state in which the reproducible doll is applied to an animal according to the present invention.

FIG. 8 is a view illustrating the state in which the reproducible doll is applied to an animal according to the present invention. More particularly, FIG. 8 is a view of an animal doll 400 according to a further variation of the present invention. Other constructions are the same as those in the above embodiments, and explanation in detail will be omitted.

As explained above, the present invention has an advantage of mimicking all behaviors of human beings by allowing for the rotation of the head, hands, feet and so on by means of the connecting bars and bending sections.

The present invention has a further advantage of providing a manufactured doll whose type is selected among a fat type, a thin type and a muscular type by arbitrarily fitting the artificial muscle sections for adjustment of a body type with the connecting bars.

The present invention has a still further advantage of providing manufactured dolls of various races by wearing the artificial skin sections of diverse colors.

The present invention has another advantage of providing a manufactured a doll whose type is selected out of a taller type and a smaller type by adjusting the size and width of the connecting bars which form the bone sections.

The present invention has yet another advantage of providing a manufactured type of doll that may be configured into a preferred doll by arbitrarily changing a variety of features, e.g., hairs, shoes, etc.

The present invention has still another advantage of being applicable to animals.

The foregoing embodiments are merely exemplary and are not to be construed as limiting the present invention. The present teachings can be readily applied to other types of apparatuses. The description of the present invention is intended to be illustrative, and is not intended to limit the scope of the claims. Many alternatives, modifications, and variations will be apparent to those skilled in the art.

What is claimed is:

1. A reproducible doll including a head, hands and feet, the doll comprising:

a plurality of connecting bars integrally connected with the head, hands and feet, respectively, to form bone sections of the doll;

a plurality of bending sections adapted to detachably connect the plurality of connecting bars with each other and each of the head, hands and feet with a corresponding one of the plurality of connecting bars to form joints of the bone sections;

a plurality of artificial skin sections separately worn on the outsides of the plurality of connecting bars connected with each other through the plurality of bending sections to form arm, leg and torso portions of the doll;

a plurality of artificial muscle sections for adjustment of a body type detachably fitted with the corresponding bending sections and connecting bars forming bone sections of the arm and leg portions and adapted to allow a user to select any one of a thin type, a fat type, a slender type and a muscular type to adjust the body type of the doll, wherein the artificial skin sections are worn on the artificial muscle sections; and wherein the artificial muscle sections are made of flexible materials having elasticity, and formed of a hollow body having openings formed at both ends thereof and a cut portion formed along a longitudinal direction thereof thereon to correspond to the shapes of the arm and leg portions of the doll.

2. The doll according to claim 1, wherein the head has insertion holes formed on the head thereof to attach or detach hair, nose, eyes, and mouth of the doll to or from the head thereof.

3. The doll according to claim 1, wherein each of the bending sections includes globular portions respectively formed on ends of the head, hands and feet and on both ends of the connecting bars, and a connecting mechanism having recesses at both ends thereof to detachably and movably receive the globular portions.

4. The doll according to claim 1, wherein the artificial skin sections are made of flexible materials having elasticity, such as silicon.

5. The doll according to claim 1, wherein the artificial skin sections are formed of any one of white, yellow and black colors.

6. The doll according to claim 1, wherein each of the hands includes fingers having the connecting bars and bending sections for detachably interconnecting the connecting bars, and a palm portion connected to the fingers, and wherein the artificial skin sections are worn on the fingers and palm portion.

7. The doll according to claim 1, wherein each of the feet includes toes having the connecting bars and bending sections for detachably interconnecting the connecting bars, and a sole portion connected to the toes, and wherein the artificial skin sections are worn on the toes and sole portion.

* * * * *